US010851436B2

(12) United States Patent
Lehnhoff et al.

(10) Patent No.: US 10,851,436 B2
(45) Date of Patent: Dec. 1, 2020

(54) METHOD FOR JOINING STEEL RAILS WITH CONTROLLED WELD HEAT INPUT

(71) Applicant: CF&I Steel L.P., Pueblo, CO (US)

(72) Inventors: Gregory Ryan Lehnhoff, Colorado Springs, CO (US); Joseph Victor Kristan, Pueblo, CO (US); Mark David Richards, Pueblo West, CO (US)

(73) Assignee: CF&I STEEL L.P., Pueblo, CO (US)

( * ) Notice: Subject to any disclaimer, the term of this patent is extended or adjusted under 35 U.S.C. 154(b) by 0 days.

(21) Appl. No.: 16/145,835

(22) Filed: Sep. 28, 2018

(65) Prior Publication Data

US 2019/0100822 A1 Apr. 4, 2019

Related U.S. Application Data

(60) Provisional application No. 62/565,282, filed on Sep. 29, 2017.

(51) Int. Cl.

| | |
|---|---|
| ***C21D 9/50*** | (2006.01) |
| ***C21D 6/00*** | (2006.01) |
| ***C22C 38/50*** | (2006.01) |
| ***C22C 38/48*** | (2006.01) |
| ***C22C 38/46*** | (2006.01) |

(Continued)

(52) U.S. Cl.

CPC ..... *C21D 9/50* (2013.01); *C21D 6/004* (2013.01); *C21D 6/005* (2013.01); *C21D 6/008* (2013.01); *C21D 9/04* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/001* (2013.01); *C21D 2211/002* (2013.01); *C21D 2211/005* (2013.01); *C21D 2211/009* (2013.01)

(58) Field of Classification Search

CPC ..... C21D 2211/001; C21D 2211/009; C21D 9/04; C21D 9/50

USPC ..... 148/534

See application file for complete search history.

(56) References Cited

U.S. PATENT DOCUMENTS

| | | | |
|---|---|---|---|
| 2,945,940 | A | 7/1960 | Schlatter |
| 5,270,514 | A | 12/1993 | Wechselberger et al. |

(Continued)

FOREIGN PATENT DOCUMENTS

| | | | |
|---|---|---|---|
| CN | 102773614 | A | 11/2012 |
| CN | 103521935 | B | 7/2015 |

(Continued)

OTHER PUBLICATIONS

International Search Report and Written Opinion dated Dec. 3, 2018 for PCT/US2018/053377.

*Primary Examiner* — Jie Yang

(74) *Attorney, Agent, or Firm* — Pearne & Gordon LLP

(57) ABSTRACT

A method for creating a welded joint between ends of two steel rails, wherein the two steel rails have a substantially pearlitic microstructure. The method includes a first heating step, an upsetting step, a first cooling step, and a second heating step and provides a means to influence a microstructure and hardness of an austenitic region of a heat affected zone (HAZ) and/or an extent of softening in a softened region of a HAZ.

41 Claims, 5 Drawing Sheets

(51) Int. Cl.

| | |
|---|---|
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 9/04*** | (2006.01) |

(56) References Cited

U.S. PATENT DOCUMENTS

| | | | |
|---|---|---|---|
| 5,992,329 | A | 11/1999 | Scheuchzer et al. |
| 6,031,197 | A | 2/2000 | Larsson |
| 7,253,380 | B2 | 8/2007 | Miller |
| 8,353,443 | B2 | 1/2013 | Sugiyama et al. |
| 8,367,960 | B2 | 2/2013 | Keefe |
| 8,487,205 | B2 | 7/2013 | Battisti et al. |
| 8,557,064 | B2 | 10/2013 | Karimine et al. |
| 9,334,546 | B2 | 5/2016 | Kristan et al. |
| 9,617,690 | B2 | 4/2017 | Saita et al. |
| 10,144,983 | B2 * | 12/2018 | Karimine ..... B23K 31/02 |
| 2005/0067381 | A1 | 3/2005 | Coomer |
| 2006/0011732 | A1 | 1/2006 | Baumert et al. |
| 2007/0007251 | A1 | 1/2007 | Kral et al. |
| 2009/0242519 | A1 | 10/2009 | Baumert et al. |
| 2012/0015212 | A1 | 1/2012 | Karimin et al. |
| 2013/0284704 | A1 | 10/2013 | Gentsch |
| 2014/0087320 | A1 | 3/2014 | Karimine et al. |
| 2015/0152516 | A1 | 6/2015 | Kimura et al. |
| 2015/0361620 | A1 | 12/2015 | Lorieux et al. |
| 2016/0039038 | A1 | 2/2016 | Vaia |
| 2017/0073793 | A1 | 3/2017 | Karimine et al. |

FOREIGN PATENT DOCUMENTS

| | | | |
|---|---|---|---|
| GB | 2299044 | A | 9/1996 |
| GB | 2403174 | A | 12/2004 |
| JP | 2007-289970 | A | 11/2007 |

* cited by examiner

METHOD FOR JOINING STEEL RAILS WITH CONTROLLED WELD HEAT INPUT

CROSS-REFERENCE TO RELATED APPLICATIONS

This application claims the benefit of U.S. Provisional Application No. 62/565,282 filed Sep. 29, 2017, the entire disclosure of which is hereby incorporated herein by reference.

FIELD OF THE INVENTION

This application relates generally to the production of a welded rail joint for use in freight and/or passenger railways, and more particularly, for use in continuously welded rail, wherein lengths of individual rails are welded together to form, in effect, longer lengths of rail.

BACKGROUND OF THE INVENTION

Rail welds are used in both freight and passenger railways to join individual rails together to form, in effect, longer lengths of rail over which trains can pass. Welded rail joints offer improved joint integrity and improved joint transition compared to other joining methods, such as joint bars. For example, joint bars require holes to be drilled in the ends of the rail, and the holes can nucleate cracks that compromise the joint integrity. Additionally, rail ends joined by joint bars do not present a continuous running surface to passing railroad wheels, which can increase noise, vibration, and dynamic forces due to train passage. Furthermore, the ends of the rails can sustain batter due to the transition from one rail to another, which can reduce the integrity of the joint. For these reasons, amongst others, welded rail joints and continuously welded rail are common in freight and passenger railways.

Common methods of rail welding include electric flash butt (EFB) welding and thermite welding. Rail EFB welding can be conducted in fixed plant locations or in field locations, such as on railway track or adjacent to railway track. Rail EFB welding utilizes electrical energy to heat the rail ends and expel (flash) heated material from the rail ends. Following heating, the rail ends are forged (upset) together to further expel material from the ends of the rails and form a metallurgical bond (joint) between the rail ends.

The EFB welding heat input results in heat affected zones (HAZs) on either side of the weld bond (fusion line). Four HAZ types may be present. A coarse grained reaustenitized HAZ may be located closest to the fusion line, and may be followed by a fine grained reaustenitized HAZ. Both the coarse and fine grained reaustenitized HAZs are reheated to an austenitic structure due to the welding heat input, and include an austenitic region. An intercritically annealed softened HAZ may be located outside of the fine grained reaustenitized HAZ, and may be followed by a subcritically annealed softened HAZ. The intercritically and subcritically annealed softened HAZs may include a softened region that forms due to the welding heat input. Outside of the subcritically annealed softened HAZ, the welding heat input is low enough that the microstructure and mechanical properties are substantially unaffected as compared to the condition prior to welding. The material outside of the subcritically annealed softened HAZ includes an unaffected region.

Rail thermite welding is typically conducted in field locations, such as on railway track or adjacent to railway track. Rail thermite welding is carried out by placing a mold around the ends of the rails to be joined, such that the mold will contain molten metal within the gap between the two rail ends. The rail ends and mold are commonly preheated using a torch to eliminate moisture and ensure proper molten metal filling and fusion. During rail thermite welding, an exothermic reaction is used to melt a thermite portion in a crucible, such that the molten metal subsequently fills the gap between the two rail ends and forms a metallurgical bond (joint) between the two rail ends. Thermite welds generally contain an as-cast structure that includes a fusion zone, in contrast to the fusion line that is found in EFB welds. The interfaces between the fusion zone and the rail ends are referred to as fusion lines. The thermite welding heat input results in HAZs outside of the fusion lines that are similar to those found in EFB welds. Since thermite welding heat input is generally greater than EFB welding heat input, thermite weld HAZs may be larger than EFB weld HAZs.

During conventional rail EFB or thermite welding, heat is input into the ends of the rail for the purposes of facilitating a metallurgical bond, influencing austenite phase transformation behavior in the austenitic region of the HAZs during subsequent cooling, and/or influencing residual stress due to thermal contraction and/or phase transformation during subsequent cooling. However, the welding heat input can also cause a softened region of the HAZs to form on either side of the fusion line. The softened HAZs can form due to subcritical or intercritical annealing of the parent rail microstructure. For example, in the case of a substantially pearlitic rail, the lamellar cementite platelets may be partially or entirely annealed to form a spheroidal morphology that is softer than the lamellar morphology.

As the welding heat input is increased, it is generally observed that the sizes of the reaustenitized HAZs and softened HAZs increase. A higher welding heat input may be beneficial in some scenarios to influence the austenite phase transformation behavior in the austenitic region of the HAZ during post-weld cooling, as well as the residual stresses development during post-weld cooling. For example, a higher weld heat input may reduce the post-weld cooling rate, thus reducing the extent of bainite and/or martensite formed in the reaustenitized HAZs. Additionally, the reduced post-weld cooling rate may reduce the residual stresses that develop.

However, a higher weld heat input may also result in a greater extent of annealing in the softened regions of the HAZs, which may manifest as a larger width of softened material and/or lower hardness of the softened material. Softened HAZs are undesirable for railway operation because they experience increased plastic flow and/or wear due to the wheel contact stresses as compared to the adjacent the austenitic region(s) of the HAZ and unaffected region(s). The increased plastic flow and/or wear in the softened region(s) of the HAZ increase the noise, vibration, and dynamic forces due to train passage. Additionally, the increased plastic flow within the soft HAZ can also result in fatigue damage, which may result in shelling that further reduces the running surface quality. Fatigue damage may also cause rail breaks under certain circumstances. Therefore, a lower welding heat input may be beneficial if it results in smaller softened HAZs.

The present invention addresses the aforementioned issues and provides a welding process that results in an improved joint between ends of adjacent rails.

BRIEF SUMMARY OF THE INVENTION

In accordance with one aspect, there is provided a method for creating a welded joint between ends of two steel rails, wherein the two steel rails have a substantially pearlitic microstructure. The method includes a first heating step wherein the ends of the two steel rails are heated to obtain within the two steel rails: an austenitic region including a microstructure substantially of austenite, the austenitic region being within and/or adjacent to the ends of the two steel rails, a softened region adjacent to the austenitic region, the softened region including a microstructure substantially of softened, annealed, spheroidized, and/or degenerate pearlite, and an unaffected region adjacent to the softened region, the unaffected region including a microstructure that has not been substantially altered as compared to a starting microstructure of the two rails. The method includes an upsetting or forging step wherein the ends of the two steel rails are forced together to obtain: a weld bond between the ends of the two steel rails, a remaining austenitic region on both sides of the weld bond, a remaining softened region on both sides of the weld bond, and a remaining unaffected region on both sides of the weld bond. A first cooling step is provided wherein a temperature of the austenitic region of at least one of the two steel rails is below an A1 temperature. A second heating step is provided wherein heat is applied to the austenitic region of at least one of the two steel rails to maintain the temperature of at least the austenitic region in a temperature range below the A1 temperature, no additional austenite is formed, and the hardness of the austenitic region after the second heating step is less than or equal to a hardness in the austenitic region without the second heating step.

In accordance with another aspect, there is provided a method for creating a welded joint between ends of two steel rails, wherein the two steel rails have a substantially pearlitic microstructure. The method includes a first heating step wherein the ends of the two steel rails are heated to obtain within the two steel rails: an austenitic region including a microstructure substantially of austenite, the austenitic region being within and/or adjacent to the ends of the two steel rails, a softened region adjacent to the austenitic region, the softened region including a microstructure substantially of softened, annealed, spheroidized, and/or degenerate pearlite, and an unaffected region adjacent to the softened region, the unaffected region including a microstructure that has not been substantially altered as compared to a starting microstructure of the two rails. The method includes an upsetting or forging step wherein the ends of the two steel rails are forced together to obtain: a weld bond between the ends of the two steel rails, a remaining austenitic region on both sides of the weld bond, a remaining softened region on both sides of the weld bond, and a remaining unaffected region on both sides of the weld bond. A first cooling step is provided wherein a temperature of the austenitic region of at least one of the two steel rails is below an A1 temperature. A second heating step is provided wherein heat is applied to the austenitic region of at least one of the two steel rails to maintain the temperature of at least the austenitic region in a transformation temperature range below the A1 temperature for a transformation hold time, and at least some of the austenite in at least the austenitic region transforms to another microstructure during the second heating step.

It is contemplated that during the first cooling step, the temperature in the austenitic region of at least one of the two steel rails may be reduced to below the A1 temperature and above a Bs temperature, and during the second heating step, the transformation temperature range may be higher than the Bs temperature but lower than the A1 temperature, and the transformation hold time may be sufficiently long such that at least the austenitic region achieves a microstructure containing a pearlite content of at least 80% and a (pearlite+ferrite) content of at least 95%.

It is contemplated that during the first cooling step, the temperature in the austenitic region of at least one of the two steel rails may be below a Bs temperature and above an Ms temperature, during the second heating step, the transformation temperature range may be higher than the Ms temperature and lower than the A1 temperature, and the transformation hold time may be sufficiently long such that at least the austenitic region achieves a microstructure containing a (bainite+pearlite+ferrite) content of at least 95%. Further, during the first cooling step and/or the second heating step, at least some austenite in at least the austenitic region transforms to bainite.

It is contemplated that the austenitic region of at least one of the two steel rails may contain a microstructure with an austenite content of at least 5% at a time when the second heating step is initiated.

It is contemplated that during the second heating step, heat may be applied to at least a web of the austenitic region of at least one of the two steel rails.

It is also contemplated that the hardness in the austenitic region of at least one of the two steel rails resulting from the second heating step may be less than or equal to a hardness in the austenitic region without the second heating step.

It is contemplated that a longitudinal distance (Lh) may be a distance between an outer extent of an austenitic region in one of the two steel rails to an outer extent of the austenitic region in the other of the two steel rails and a weld joint centerline may be halfway between the two outer extents of the austenitic regions of the two steel rails. Further, during the second heating step, heat may be applied to the austenitic region of at least one of the two steel rails within a distance of 0.2 Lh from the weld joint centerline.

It is contemplated that during the second heating step, heat may also be applied to the weld bond, the softened region and/or the unaffected region on one or both sides of the weld bond.

It is contemplated that the during the aforementioned second heating step that the heat may also be applied to at least a web of the weld bond, softened region and/or the unaffected region of one or both sides of the weld bond.

It is contemplated that a means of applying heat to achieve the first heating step may also be applied during and/or for up to 10 seconds after the upsetting step.

It is contemplated that during the first cooling step, heat may be applied to the weld bond, one austenitic region, and/or both austenitic regions, and a rate of heat input may be lower than a rate of cooling, such that a temperature of at least one austenitic region decreases with time.

It is contemplated that during the first heating step, the heat may be applied using electric flashing, electric resistance, induction, friction, laser beam, convection, radiation, and/or exothermic reaction, applied individually, sequentially, or simultaneously.

It is contemplated that natural cooling may be used during the first cooling step.

It is contemplated that during the first cooling step, the cooling is achieved at least in part by flowing a cooling media over the weld bond and/or the austenitic region, softened region, and/or unaffected region on one or both sides of the weld bond.

It is contemplated that during the second heating step, the heat may be applied using electric resistance, induction, convection, and/or radiation, applied individually, sequentially, or simultaneously.

The method may further include a step of partially or fully removing an upset material that protrudes beyond an original profile of the two rails after the upsetting step and before the second heating step.

The method may further include a step of partially or fully removing an upset material that protrudes beyond an original profile of the two rails after the second heating step.

The method may further include a second cooling step after the second heating step, wherein the weld bond and the austenitic regions, softened regions, and unaffected regions on both sides of the weld bond are cooled to ambient temperature.

It is contemplated that natural cooling may be used during the second cooling step.

It is contemplated that during the second cooling step, the cooling may be achieved at least in part by flowing a cooling media over the weld bond and/or the austenitic region, softened region, and/or unaffected region on one or both sides of the weld bond It is also contemplated that an alignment of the two rails and/or the welded joint may be altered after the upsetting step.

In accordance with another aspect, there is provided a method for creating a welded joint between ends of two steel rails, wherein the two steel rails have a substantially pearlitic microstructure. The method includes a first heating step wherein ends of the two steel rails are heated to obtain within the two steel rails: an austenitic region including a microstructure substantially of austenite, the austenitic region being within and/or adjacent to the ends of the two steel rails, a softened region adjacent to the austenitic region, the softened region including a microstructure substantially of softened, annealed, spheroidized, and/or degenerate pearlite, and an unaffected region adjacent to the softened region, the unaffected region including a microstructure substantially altered as compared to the starting microstructure of the two steel rails. The method further includes an upsetting or forging step wherein the ends of the two rails are forced together to obtain: a weld bond between the two steel rail ends, a remaining austenitic region on both sides of the weld bond, a remaining softened region on both sides of the weld bond, and a remaining unaffected region on both sides of the weld bond. A first cooling step is provided wherein a temperature in the austenitic region of at least one of the two steel rails is below an Ms temperature, such that at least some martensite is formed from austenite in at least the austenitic region. A second heating step may be provided wherein heat is applied to the austenitic region of at least one of the two steel rails to raise and maintain the temperature of at least the austenitic region above the Ms temperature and below an A1 temperature for sufficient time, such that at least the austenitic region achieves a microstructure containing at least some tempered martensite and a (tempered martensite+bainite+pearlite+ferrite) content of at least 95%, and wherein tempered martensite is martensite with a hardness less than or equal to 600 Hv.

It is contemplated that in the foregoing method the austenitic region of at least one of the two steel rails may contain a microstructure with an austenite content of at least 5% at a time when the second heating step is initiated.

It is contemplated that in the foregoing method during the second heating step, heat may be applied to at least a web of the austenitic region of at least one of the two rails.

It is contemplated that in the foregoing method the hardness in the austenitic region of at least one of the two steel rails resulting from the second heating step may be less than or equal to a hardness in the austenitic region without the second heating step.

It is contemplated that in the foregoing method a longitudinal distance (Lh) may be a distance between an outer extent of an austenitic region in one of the two steel rails to an outer extent of the austenitic region in the other of the two steel rails, and a weld joint centerline may be halfway between the two outer extents of the austenitic regions of the two steel rails. Further, during the second heating step, heat may be applied to the austenitic region of at least one of the two steel rails within a distance of 0.2 Lh from the weld joint centerline.

It is contemplated that in the foregoing method during the second heating step, heat may also be applied to the weld bond, the softened region and/or the unaffected region on one or both sides of the weld bond.

It is contemplated that in the foregoing method during the second heating step, the heat may also be applied to at least a web of the weld bond, softened region and/or the unaffected region of one or both sides of the weld bond.

It is contemplated that in the foregoing method a means of applying heat to achieve the first heating step may also be applied during and/or for up to 10 seconds after the upsetting step.

It is contemplated that in the foregoing method during the first cooling step, heat may be applied to the weld bond, one austenitic region, and/or both austenitic regions, and a rate of heat input may be lower than a rate of cooling, such that a temperature of at least one of the austenitic regions decreases with time.

It is contemplated that in the foregoing method during the first heating step, the heat may be applied using electric flashing, electric resistance, induction, friction, laser beam, convection, radiation, and/or exothermic reaction, applied individually, sequentially, or simultaneously.

It is contemplated that in the foregoing method natural cooling may be used during the first cooling step.

It is contemplated that in the foregoing method during the first cooling step, the cooling may be achieved at least in part by flowing a cooling media over the weld bond and/or the austenitic region, softened region, and/or unaffected region on one or both sides of the weld bond.

It is contemplated that in the foregoing method during the second heating step, the heat may be applied using electric resistance, induction, convection, and/or radiation, applied individually, sequentially, or simultaneously.

It is contemplated that the method may further include a step of partially or fully removing an upset material that protrudes beyond an original profile of the two steel rails after the upsetting step and before the second heating step.

It is contemplated that the method further may include a step of partially or fully removing an upset material that protrudes beyond an original profile of the two steel rails after the second heating step.

It is contemplated that the method may further include a second cooling step after the second heating step, wherein the weld bond and the austenitic regions, softened regions, and unaffected regions on both sides of the weld bond are cooled to ambient temperature.

It is contemplated that in the foregoing method natural cooling may be used during the second cooling step.

It is contemplated that in the foregoing method during the second cooling step, the cooling may be achieved at least in part by flowing a cooling media over weld bond and/or the austenitic region, softened region, and/or unaffected region on one or both sides of the weld bond.

It is contemplated that in the foregoing method an alignment of the two steel rails and/or the welded joint may be altered after the upsetting step.

DESCRIPTION OF EXAMPLE EMBODIMENTS

Figure 1A:
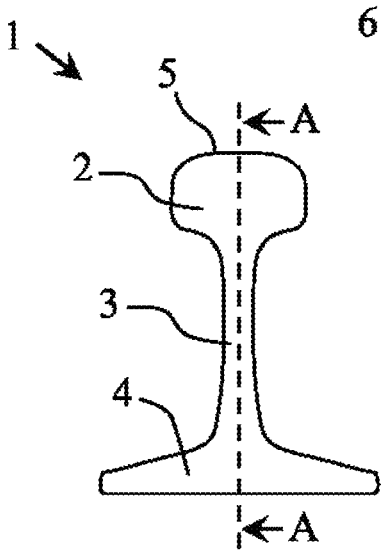
FIG. 1A is an end view of a rail.

The present invention relates to a method for creating a welded joint between ends of two steel rails, wherein the steel rails have a substantially pearlitic microstructure. Each rail may include a head, base (foot), and web portion. The rail head provides a running surface for the passage of a wheel, such as a railroad wheel. The rail base provides a means of supporting the rail on an underlying structure, such as a rail tie and/or tie plate (seat). The rail web is a vertical section that connects the rail head and rail base. The welded joint can be beneficial for certain applications by providing a continuous running surface for a passing wheel. In contrast, a joint bar, which can be connected to the webs of two adjoining rails using bolts, does not provide a continuous running surface. The non-continuous running surface resulting from a joint bar application may lead to increased impact loading on the rail ends and the passing wheel.

In embodiments of the present invention, a steel rail contains a microstructure that may be substantially pearlitic at ambient temperature. A substantially pearlitic microstructure may be considered as a microstructure containing at least 80% pearlite, for example. A substantially pearlitic microstructure may also contain a ferrite content of up to 20%, for example. A substantially pearlitic microstructure can be achieved over a wide range of steel rail chemical compositions. For example, an eutectoid composition, which may contain approximately 0.70 to 0.80 wt pct Carbon, can form a substantially fully pearlitic microstructure. Under specific cooling conditions during austenitic decomposition (transformation), even non-eutectoid steel compositions can form a substantially fully pearlitic microstructure. For example, in hypoeutectoid steels, the ferrite content in the pearlite constituent can be larger than predicted by an equilibrium or metastable equilibrium phase diagram. Furthermore, in a hypereutectoid steel, the cementite content in the pearlite constituent can be larger than predicted by an equilibrium or metastable equilibrium phase diagram. For successful application of the rail in service, for example in a railroad application at ambient temperature, it may not be necessary that the rail have a fully pearlitic microstructure. For example, ferrite may not be considered deleterious and may be present in the microstructure in quantities up to 20%. However, at ambient temperature the rail may have no more than 5% of microstructures other than pearlite or ferrite. In other words, a substantially pearlitic microstructure may contain a pearlite content of at least 80% and a (pearlite+ferrite content) of at least 95%. Microstructures other than pearlite or ferrite may include bainite, martensite, cementite, and/or retained austenite.

Ferrite is a body centered cubic arrangement of iron (and substitutional alloying elements) with a relatively low solubility for Carbon. For example, the solubility of Carbon in ferrite may be considered as approximately 0.02 wt pct. Ferrite (grain boundary ferrite, primary ferrite, or proeutectoid ferrite) can be considered to form when austenite with a hypoeutectoid carbon content is maintained below an upper ferrite formation (A3) temperature but above a lower ferrite formation temperature, also referred to as a eutectoid, (A1) temperature, for sufficient time. The sufficient time can be achieved through isothermal holding, or through cooling at a sufficiently slow rate from above the A3 temperature to below the A3 temperature but above the A1 temperature. Ferrite has a comparatively low strength and high ductility. Ferrite may also be present in the pearlite constituent (described below).

Cementite is an intermetallic compound with a nominal chemical formula of $Fe_3$—C. Cementite may be considered as a metastable phase compared to graphite, which may be the equilibrium phase. Nonetheless, cementite can be formed in steels, including rail steels. Cementite has a comparatively high strength and low ductility. Cementite may be beneficial when present in the pearlite structure (described below), for example. However, isolated cementite, for example on austenite grain boundaries, may be deleterious because it can form a continuous network for brittle fracture. Grain boundary cementite (primary cementite or proeutectoid cementite) can be considered to form when austenite with a hypereutectoid carbon content is maintained below an upper critical (Acm) temperature but above the A1 temperature for sufficient time. The sufficient time can be achieved through isothermal holding, or through cooling at a sufficiently slow rate from above the Acm temperature to below the Acm temperature but above the A1 temperature.

Pearlite is a lamellar mixture of ferrite and cementite. At equilibrium, pearlite, or at least microstructures substantially made up of pearlite, may be considered to form when austenite with a eutectoid carbon content is maintained below the A1 temperature but above a bainite start (Bs) temperature for sufficient time. The sufficient time can be achieved through isothermal holding, or through cooling at a sufficiently slow rate from above the A1 temperature to below the A1 temperature but above the Bs temperature. Note that depending on the steel chemistry and cooling rate, the bainite and pearlite formation regimes may overlap. However, to obtain a substantially pearlitic microstructure, it may be helpful to minimize bainite formation, for example by maintaining the temperature above the Bs temperature. At equilibrium, pearlite contains approximately 87% ferrite and 13% cementite. However, as described above, it may be possible to obtain a fully pearlitic structure with various amounts of ferrite (and cementite) by adjusting the chemical composition to be hypo- or hyper-eutectoid. In addition to chemical composition, the temperature (or cooling rate) by which the pearlite is formed may also influence the amounts of ferrite and cementite present in the pearlite constituent. For example, rapid cooling through the Austenite+Ferrite or Austenite+Cementite phase fields for hypo- and hyper-eutectoid steels, respectively, may promote non-equilibrium amounts of ferrite and cementite in the pearlite structure. Pearlite benefits from the different properties of ferrite and cementite and the lamellar arrangement of ferrite and cementite. The properties of pearlite, such as strength and ductility, can be further modified by modifying the fractions of ferrite and cementite present, along with the spacing between adjacent lamellae, which is referred to as the interlamellar spacing. In general, pearlite has a high strength, high work hardening capability, good wear resistance, and good rolling contact fatigue (RCF) resistance. Thus pearlite may be a beneficial microstructure for rail applications, such as railroad rail.

Bainite is a mixture of ferrite (which may be supersaturated with respect to Carbon) and a Carbon-rich constituent. The Carbon-rich constituent may be a carbide (such as cementite) or retained austenite (described below). Bainite may be considered to form when austenite is maintained below the Bs temperature but above a martensite start (Ms) temperature for sufficient time. The sufficient time can be achieved through isothermal holding, or through cooling at a sufficiently slow rate from above the Bs temperature to below the Bs temperature but above the Ms temperature. Bainitic microstructures can display combinations of high strength and ductility. However, at a given strength level, pearlite may provide better wear resistance than bainite.

Martensite is a body centered tetragonal structure that may be formed when austenite is cooled to below the Ms temperature at a sufficiently high rate that other austenitic decomposition products, such as ferrite, cementite, pearlite, and/or bainite, may not form. The sufficiently high cooling rate may help ensure that austenite is not maintained in the transformation temperature range(s) of other decomposition products for sufficient time. Martensite can from as laths or plates, depending on the austenite composition. Martensite formation may not involve diffusion, and thus the martensite may have the same composition as the austenite from which it formed. As-formed (untempered) martensite generally has high strength and low ductility. This may be particularly true for steel compositions capable of forming substantially pearlitic microstructures, since such compositions may generally have high carbon levels, and carbon may increase the hardness and decrease the ductility of as-formed martensite. The ductility of martensite can be increased, and the strength can be decreased, by tempering the as-formed martensite. Tempering involves heating the as-formed martensite to a higher temperature to promote the precipitation of carbide particles from carbon-supersaturated martensite laths or plates. The extent of tempering can be adjusted by adjusting the temperature and time of tempering. For example, the tempering temperature can vary between approximately 100° C. up to the A1 temperature, although common tempering temperature ranges are 100 to 260° C. and 320 to 650° C. In addition to tempering temperature, the tempering time can also be varied from on the order of several seconds to several hours, depending on the desired properties. For example, some embodiments may benefit from a tempered martensite hardness below 600 Hv (Vickers Hardness). Other embodiments may benefit from a tempered martensite hardness below 550 Hv. Other embodiments may benefit from a tempered martensite hardness below 500 Hv. Other embodiments may benefit from a tempered martensite hardness below 450 Hv. Still other embodiments may benefit from a tempered martensite hardness below 400 Hv. At a given strength (hardness) level, pearlite may provide better wear resistance than martensite.

Retained austenite may be austenite that persists to ambient temperature. Retained austenite may be present if austenite is cooled at a sufficiently high rate that austenite decomposition products, such as ferrite, cementite, pearlite, and/or bainite, at least do not completely consume the austenite and if ambient temperature is above a martensite finish (Mf) temperature. Some amount of retained austenite may be transformed to martensite if the ambient temperature is lowered (such that the ambient temperature is further below the Ms temperature and closer to or below the Mf temperature), or if the austenite is subjected to mechanical deformation. Retained austenite can also be transformed to other decomposition products, such as ferrite, cementite (or other carbide type), pearlite, bainite, or some mixture thereof, by reheating the retained austenite to a temperature range appropriate for the decomposition product(s). For steel compositions capable of forming substantially pearlitic microstructures, retained austenite may be generally undesirable because the presence of retained austenite may likely accompany some fraction of martensite, which may have low ductility in the as-formed state as mentioned above. Additionally, the retained austenite may undergo additional transformation to martensite in service if the temperature of the austenite is lowered or if the austenite is mechanically deformed as mentioned above. Furthermore, the retained austenite, having a generally high carbon content in steel compositions capable of forming substantially pearlitic microstructures, may have a ductility that is lower than preferred or required.

The critical temperatures mentioned above, such as the A1, A3, Acm, Bs, and Ms temperatures can depend on the chemical composition of the rail steel and the heating and/or cooling rates considered. Since any steel rail composition capable of achieving a substantially pearlitic microstructure may be suitable for the present rail welding methods, it may be advantageous to reference these critical temperatures generically, rather than with specific temperature values. However, the following ranges for the critical temperatures may be instructive:

The eutectoid (A1) temperature: 700 to 750° C.;

The upper ferrite formation (A3) temperature: 700 to 800° C.;

The upper critical (Acm) temperature: 700 to 850° C.;

The bainite start (Bs) temperature: 300 to 500° C.; and

The martensite start (Ms) temperature: 100 to 300° C.

Any steel rail composition capable of achieving a substantially pearlitic microstructure may be suitable for the present rail welding methods. Thus, the exact chemistry of the steel is not specifically limited in the present invention. However, the following ranges for chemical composition may be instructive:

C: preferably 0.6 to 1.2, more preferably 0.7 to 1.0, or even more preferably 0.75 to 0.95 wt pct;

Mn: preferably 0.1 to 1.5, or more preferably 0.25 to 1.25 wt pct;

Si: preferably 0.1 to 1.5, or more preferably 0.15 to 1.0 wt pct;

Cr: preferably 0.0 to 1.5, more preferably 0.1 to 1.0, or even more preferably 0.2 to 0.8 wt pct;

Ti: preferably 0 to 0.05, more preferably 0 to 0.02, or even more preferably 0 to 0.015 wt pct;

V: preferably 0 to 0.1, or more preferably 0 to 0.06 wt pct;

Nb: preferably 0 to 0.1, or more preferably 0 to 0.06 wt pct;

Mo: preferably 0 to 0.1, or more preferably 0 to 0.05 wt pct;

Al: preferably 0 to 0.1, more preferably 0 to 0.05, or even more preferably 0 to 0.01 wt pct;

N: preferably 0 to 200, more preferably 0 to 150, or even more preferably 0 to 120 ppm;

S: preferably 0 to 0.05, or more preferably 0.005 to 0.025 wt pct;

P: preferably 0 to 0.05, or more preferably 0 to 0.025 wt pct;

Cu: preferably 0 to 1.0, or more preferably 0 to 0.4 wt pct;

Ni: preferably 0 to 1.0, or more preferably 0 to 0.4 wt pct;

Rare Earth Metals: preferably 0 to 0.05 wt pct; and

H: preferably 0 to 10, more preferably 0 to 5, or even more preferably 0 to 2 ppm.

Other elements, such as Pb, Sn, As, and/or Sb, for example, may also be present in the steel rail as impurities, and may generally be considered to have a content below 0.05 wt pct, although the levels of impurities are not specifically limited in the present invention.

Rails with a substantially pearlitic microstructure may be considered to have a surface hardness of at least 300 BHN (Brinell), and do not generally exceed 500 BHN. However, these hardness levels do not limit the application of the present invention.

Figure 1B:
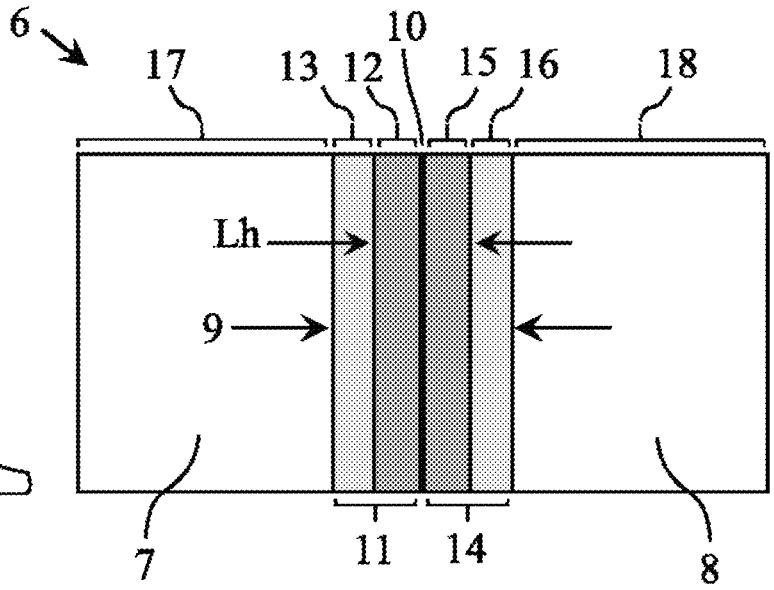
FIG. 1B is a section view taken along section line A-A of FIG. 1B showing an EFB weld joining ends of two rails.

Referring now to FIG. 1A, an end view of a rail is shown. FIG. 1B illustrates a section view taken along a longitudinal section A-A 6 of FIG. 1A through a rail EFB weld 9 between a first rail 7 and a second rail 8 is shown. The rail EFB weld 9 includes a weld bond 10 (fusion line) between the first rail 7 and the second rail 8, a heat affected zone (HAZ) 11 in the first rail 7, and a HAZ 14 in the second rail 8. The HAZ 11 in the first rail 7 contains an austenitic region 12 and a softened region 13. The HAZ 14 in the second rail 8 contains an austenitic region 15 and a softened region 16. The term HAZ may refer to the HAZ in either rail individually or those in both rails. Outside of the HAZ there is an unaffected region 17 in the first rail 7 and an unaffected region 18 in the second rail 8. The length from the outer extent of austenitic region 12 to the outer extent of austenitic region 15, including the weld bond 10, is indicated as Lh. A transverse section 1 is also shown to identify the various portions of the rail, including the rail head 2, the rail web 3, the rail base 4, and the running surface 5. The running surface 5 includes any part of the rail head 2 that is contacted by a passing railroad wheel. Since the rail head 2 and/or running surface 5 may deform and/or wear away with accumulated wheel passage, the running surface 5 may change over time.

Figure 2:
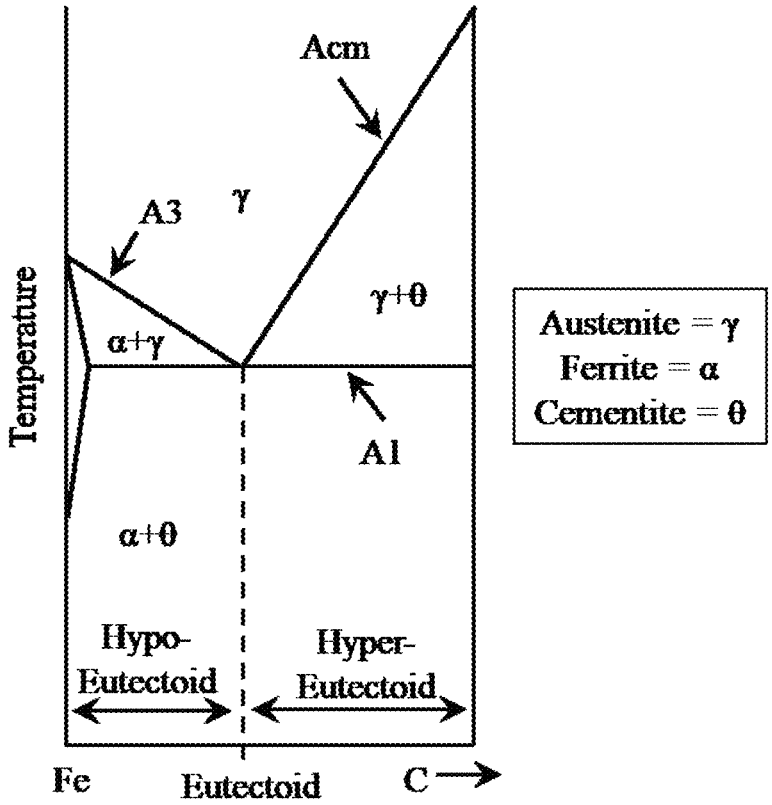
FIG. 2 is an iron-cementite metastable equilibrium phase diagram.

Referring now to FIG. 2, an iron-cementite (metastable) equilibrium phase diagram, showing three phases that may be expected at equilibrium, depending on temperature and steel composition: austenite, ferrite, and cementite, is shown. Since rail welding may involve transient heating and cooling, the steel may not be under equilibrium conditions. Thus, phases and/or microstructural constituents not predicted under equilibrium conditions may exist in rail welds. For example, bainite and martensite are not predicted under equilibrium, but may form if the steel is cooled sufficiently from the austenitic phase field. Additionally, austenite may be retained to temperatures lower than predicted by the equilibrium diagram if the cooling rate is sufficiently high to avoid ferrite, cementite, or bainite formation and the temperature is above the martensite finish temperature. Additionally, the equilibrium phase diagram predicts that austenite, ferrite, and cementite will only coexist at the A1 temperature and with a steel composition equal to the eutectoid composition. However, material heated into the (austenite+cementite) phase field may also have ferrite present under non-equilibrium conditions. Similarly, material heated into the (austenite+ferrite) phase field may also have cementite present under non-equilibrium conditions. This means that even hypo-eutectoid steels may undergo intercritical spheroidization of pearlitic cementite, since the pearlitic cementite may not fully dissolve in the intercritical temperature range between A1 and A3 under non-equilibrium conditions. Since the rail welding method may not occur under equilibrium conditions, the equilibrium diagram is shown for informational purposes only and does not limit the invention. The invention is not restricted to occur under equilibrium or metastable equilibrium conditions.

Figure 3:
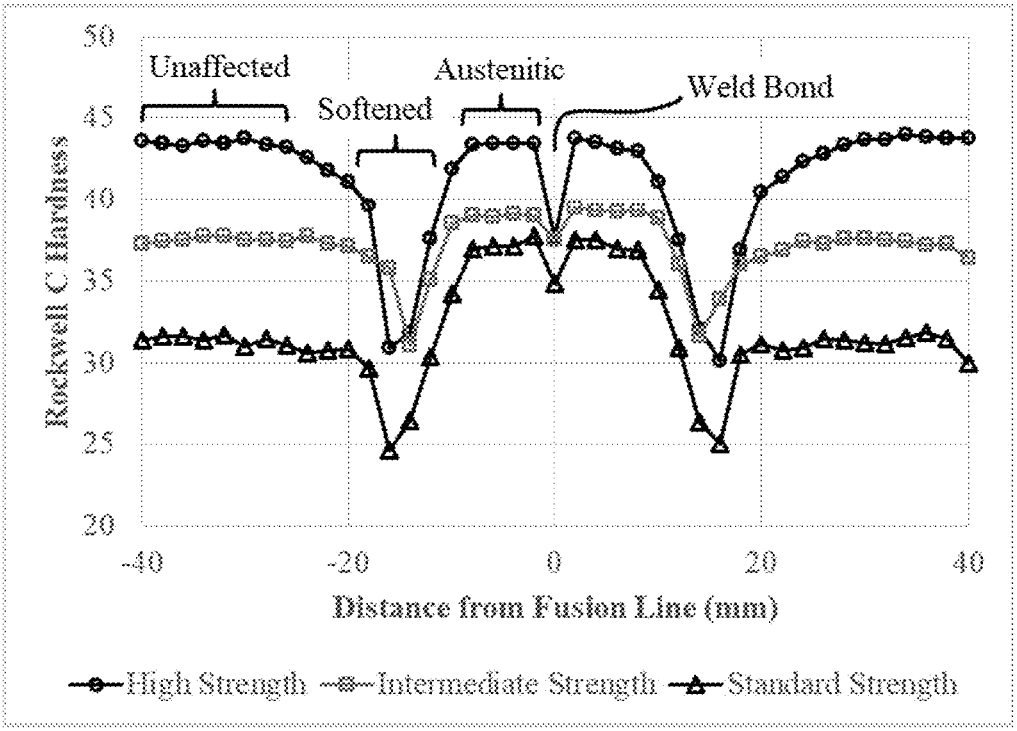
FIG. 3 is a diagram illustrating a longitudinal weld centerline hardness traverse data from conventional rail EFB welds obtained from 5 mm below a running surface of high strength, intermediate strength, and standard strength rails.

Referring now to FIG. 3, a longitudinal weld centerline hardness traverse data from conventional rail EFB welds obtained from 5 mm below the running surface of high strength, intermediate strength, and standard strength rails is shown. The dimensions and hardness values are for demonstration purposes only and do not limit the application of the present invention. Starting at −40 mm from the fusion line, all three hardness traverses are within the unaffected region of the first rail. At a distance closer to the fusion line (weld bond), all three hardness traverses enter the softened region of the first rail HAZ. The outer portion of the softened region corresponds to subcritical annealing and the inner portion corresponds to intercritical annealing. Still closer to the weld bond, all three hardness traverses enter the austenitic region of the first rail HAZ. Finally, at 0 mm from the fusion line, all three hardness traverses have an indent on the fusion line (weld bond). The fusion line hardness may differ from the adjacent austenitic region hardness values because the fusion line may have contained higher temperature steel during welding, and higher temperatures will promote, for example, decarburization of the steel. Decarburization of the steel may reduce the hardness, and local decarburization at the fusion line may decrease the hardness of the fusion line. The hardness data to the right of the fusion line substantially mirrors the data to the left of the fusion line for all three hardness traverses because the welds were made between similar rails in all three cases. However, the present invention is not limited to weld joints made between similar rails, including rail chemistry and/or hardness. It is contemplated that in the case where the weld joint is made between dissimilar rails, it may be beneficial to apply embodiments of the present invention in a different manner on either side of the weld bond. The microstructure and hardness of the austenitic and softened regions of the HAZ may be influenced by the parent rail chemistry and hardness, and thus dissimilar rails joined together may benefit from dissimilar applications of the first cooling step and/or second heating step, for example.

Figure 4:
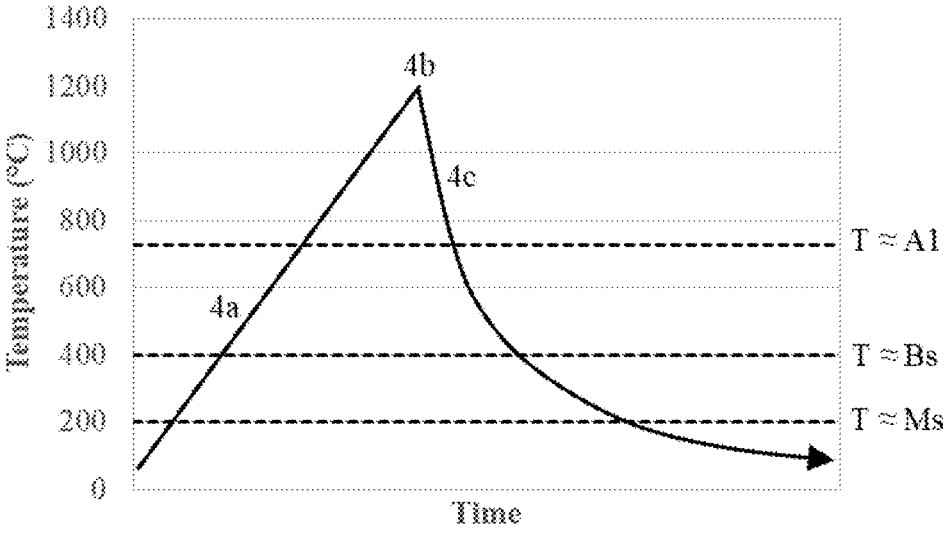
FIG. 4 is a diagram illustrating a time-temperature history experienced by an austenitic region of a conventional rail EFB weld.

Referring now to FIG. 4, a diagram illustrating a time-temperature history experienced by an austenitic region of a conventional rail EFB weld is shown. The temperature starts at ambient temperature and is increased during the first heating step (4*a*) substantially up to the point of the upsetting step (4*b*). Following the upsetting step, the weld is cooled back to ambient temperature during the first cooling step (4*c*). Approximate examples of reference temperatures, including the A1, Bs, and Ms temperatures are shown for reference, but do not limit the application of the present invention.

Figure 5:
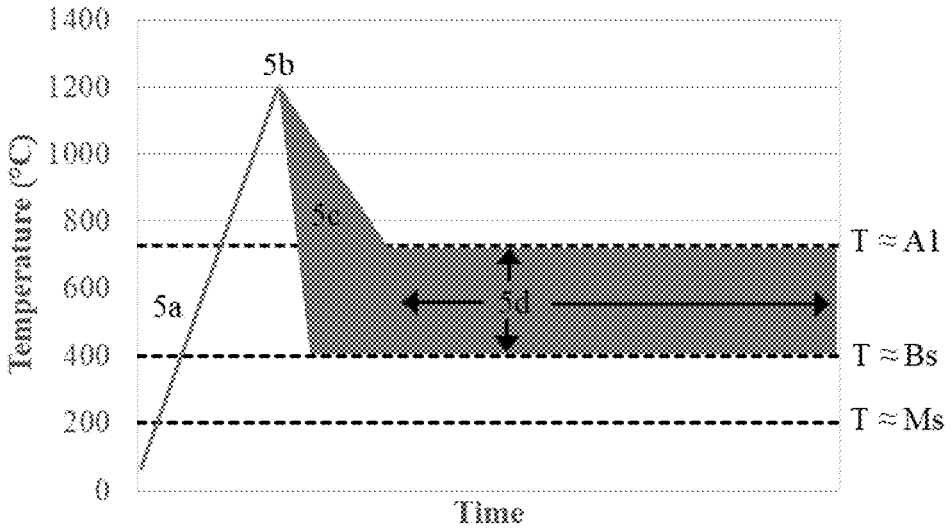
FIG. 5 is a diagram illustrating a time-temperature history experienced by an austenitic region of a rail weld according to an embodiment of the present invention.

Referring to FIG. 5, a diagram illustrating a time-temperature history experienced by an austenitic region of a rail weld according to one embodiment of the present invention is shown. The time-temperature history for the first heating step (5*a*) and upsetting step (5*b*) may be similar to or different from those in the conventional rail EFB weld shown in FIG. 4 steps (4*a*) and (4*b*), respectively. For example, the first heating step (5*a*) may be shorter than (4*a*). The first cooling step (5*c*) may be similar to or different from (4*c*) in some aspects. For example, the cooling rate of (5*c*) may exceed that of (4*c*). In the case of (5*c*), the cooling is arrested in a temperature range between the A1 and Bs temperatures. Following (5*c*), a second heating step (5*d*) is applied. The second heating step is carried out in a temperature range between the A1 and Bs temperatures, such that the decomposition of austenite within the austenitic region can be influenced. Approximate examples of reference temperatures, including the A1, Bs, and Ms temperatures are shown for reference, but do not limit the application of the present invention.

Figure 6:
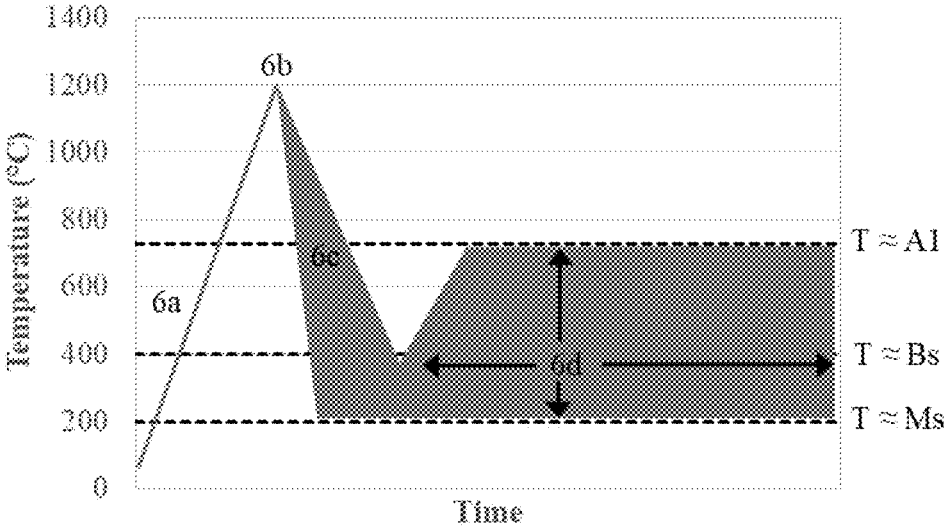
FIG. 6 is a diagram illustrating a time-temperature history experienced by an austenitic region of a rail weld according to another embodiment of the present invention.

Referring now to FIG. 6, a diagram illustrating a time-temperature history experienced by an austenitic region of a rail weld according to one embodiment of the present invention is shown. The time-temperature history for the first heating step (6*a*) and upsetting step (6*b*) may be similar to or different from those shown for another embodiment in FIG. 5 as steps (5*a*) and (5*b*), respectively. The first cooling step (6*c*) may be similar to or different from (5*c*) in some aspects, but in the case of (6*c*), the cooling is arrested in a temperature range between the Bs and Ms temperatures. Following (6*c*), a second heating step (6*d*) is applied. The second heating step is carried out in a temperature range between the A1 and Ms temperatures, such that the decomposition of austenite within the austenitic region can be influenced. Approximate examples of reference temperatures, including the A1, Bs, and Ms temperatures are shown for reference, but do not limit the application of the present invention.

Figure 7:
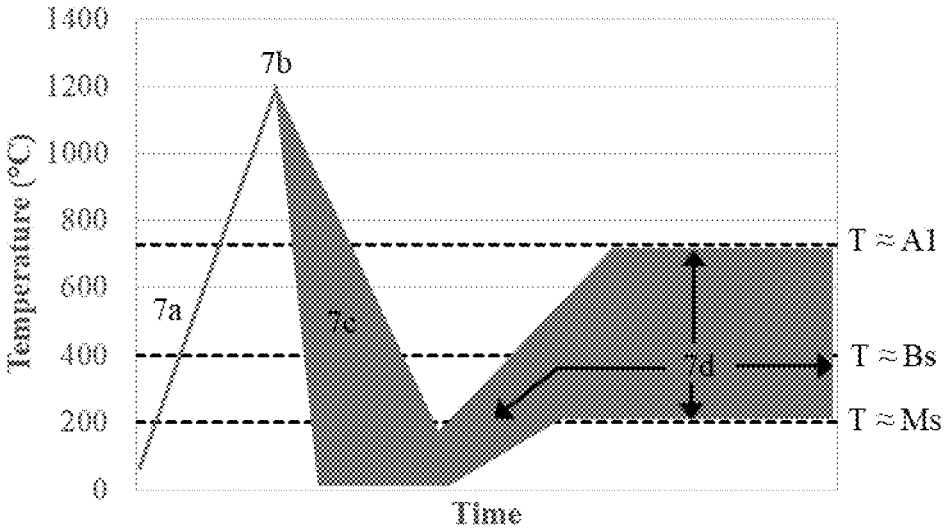
FIG. 7 is a diagram illustrating a time-temperature history experienced by an austenitic region of a rail weld according to yet another embodiment of the present invention.

Referring now to FIG. 7, a diagram illustrating a time-temperature history experienced by an austenitic region of a rail weld according to one embodiment of the present invention is shown. The time-temperature history for the first heating step (7*a*) and upsetting step (7*b*) may be similar to or different from those shown for another embodiment in FIG. 5 as steps (5*a*) and (5*b*), respectively. The first cooling step (7*c*) may be similar to or different from (5*c*) in some aspects, but in the case of (7*c*), the cooling is carried out until the temperature is below the Ms temperature. Following (7*c*), a second heating step (7*d*) is applied. The second heating step is carried out in a temperature range between the A1 and Ms temperatures, such that the decomposition of austenite and/or the tempering of martensite within the austenitic region can be influenced. Approximate examples of reference temperatures, including the A1, Bs, and Ms temperatures are shown for reference, but do not limit the application of the present invention.

Figure 8:
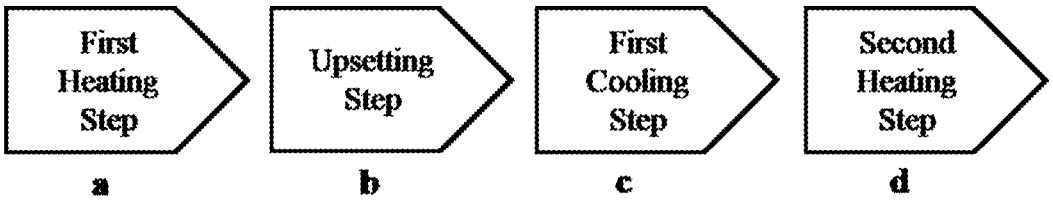
FIG. 8 is a flow chart showing steps of one embodiment of the present invention.

Referring now to FIG. 8, a flow chart of steps of an embodiment of the present invention is shown. The steps include a first heating step (a), an upsetting (forging) step (b), a first cooling step (c), and a second heating step (d).

Figure 9:
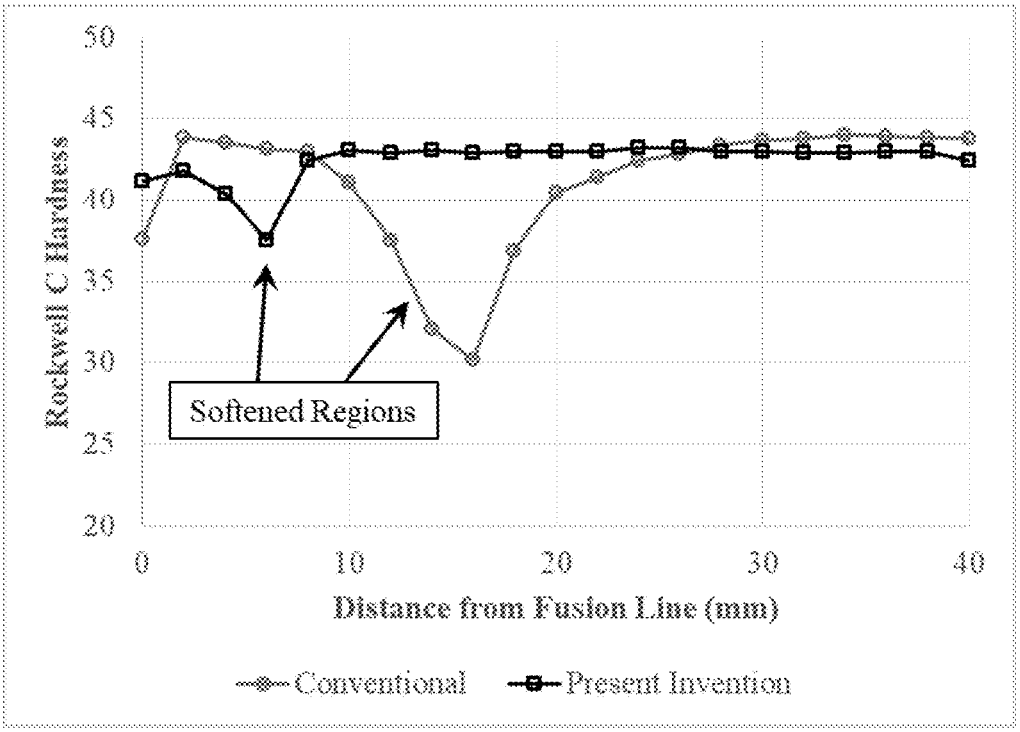
FIG. 9 is a diagram illustrating a longitudinal weld hardness traverse from a subsized sample welded using one embodiment of the present invention, measured 5 mm below an original running surface of a high strength rail wherein data from a conventional high strength rail EFB weld is shown for comparison.

Referring to FIG. 9, a diagram illustrating a longitudinal weld hardness traverse from a subsized sample welded using an embodiment of the present invention, measured 5 mm below the original running surface of a high strength rail is shown. Data from a conventional high strength rail EFB weld is shown for comparison. The hardness traverses include one half of a weld and start at the weld bond (fusion line), move into the austenitic region, softened region, and then the unaffected region. The hardness data shows that an embodied method of the present invention may be used to form a narrower and harder softened region compared to a conventional rail EFB weld. Additionally, the hardness data shows that an embodied method of the present invention may be used to achieve hardness within the austenitic region that is similar to the parent rail (unaffected region) hardness. Thus, the embodied method has utility in railway applications. The subsized weld was made between two rectangular prism pieces sectioned from the center of a rail head of high strength rail. The subsized pieces had a horizontal width of 0.75", a vertical height of 2", and a longitudinal length of 6". The subsized pieces were machined such that their upper surface was 0.04" below the crown (highest portion of the running surface) of the rail. The dimensions of the subsized pieces and subsized welds were selected to match the capabilities of a laboratory scale EFB welder and demonstrate the utility of the present invention, and do not limit the application of the present invention. The present invention may be used, for example, on full rail sections. The full rail sections may be as-manufactured (match a nominal rail profile) or they may be altered from an as-manufactured profile due to grinding, milling, deformation, and/or wear from maintenance, service, and/or other means of modification.

Figure 10:
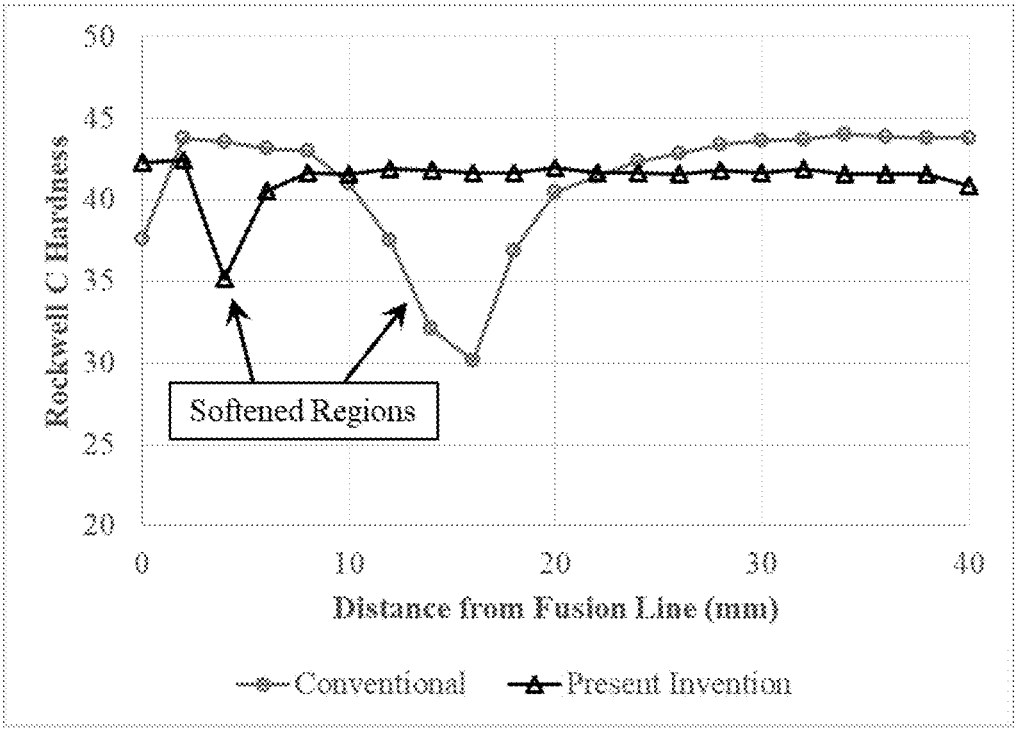
FIG. 10 is a diagram illustrating a longitudinal weld hardness traverse from a subsized sample welded using an embodiment of the present invention, measured 5 mm below an original running surface of a high strength rail wherein data from a conventional high strength rail EFB weld is shown for comparison.

Referring now to FIG. 10, a diagram illustrating a longitudinal weld hardness traverse from a subsized sample welded using an embodiment of the present invention, measured 5 mm below the original running surface of a high strength rail is shown. Data from a conventional high strength rail EFB weld is shown for comparison. The description in the above paragraph regarding FIG. 9 also applies to FIG. 10.

It is contemplated that the present invention may provide a method for creating a welded joint between the ends of two steel rails, wherein the steel rails have a substantially pearlitic microstructure. The disclosed method may include at least the following steps:

A first heating step, an upsetting step, a first cooling step, and a second heating step. Unless otherwise noted, the steps are performed in the order indicated. It is contemplated that additional steps may be included and are described in detail below.

First step:

1. A first heating step wherein both rail ends are heated to obtain within both rails:
   a. A microstructure that may be substantially of austenite in a region within and/or adjacent to the heated rail end, hereafter referred to as the austenitic region, and
   b. Adjacent to the austenitic region, a microstructure that may be substantially of softened, annealed, spheroidized, and/or degenerate pearlite, hereafter referred to as the softened region, and
   c. Adjacent to the softened region, a microstructure that has not been substantially altered as compared to the starting microstructure of the rail, hereafter referred to as the unaffected region The means of heating the rail ends is not limited, as long as the heating means is capable of heating the rail ends to obtain the microstructure regions described above. For example, in some embodiments, electric flash butt (EFB) welding may be used. EFB welding heats the rail ends by passing an electrical current through the ends of the two rails to be welded. The electric current can heat the rails by the formation of an arc if a gap exists between the rails at the time when current is passed, by contact of asperities on the rail ends resulting in local heating and material expulsion (flashing), and/or by resistive heating if the rails are brought into contact while the current is passed. In other embodiments, friction welding may be used to heat the rails. In the case of friction heating, the rail ends are displaced relative to one another under the application of a butting force to cause frictional heating of the rail ends. In other embodiments, induction, laser beam, convection, radiation, and/or exothermic reaction, may be used individually, sequentially, or simultaneously, along with the aforementioned electric flashing, electric resistance, and/or friction heating means.

It is contemplated that the first heating step may be beneficial to the disclosed method because it may heat the rail ends to a higher temperature such that the rail ends may be more easily forged to form a weld bond.

Second step:

2. An upsetting or forging step wherein the rail ends are forced together to obtain:
   a. A weld bond between the two rail ends
   b. A remaining austenitic region on both sides of the weld bond
   c. A remaining softened region on both sides of the weld bond
   d. A remaining unaffected region on both sides of the weld bond The means of achieving the upsetting step is not limited, as long as the upsetting means is capable of producing a weld bond between the two rail ends and achieving the microstructure regions described above. For example, in some embodiments, a device containing clamps to grab the rails, a hydraulic cylinder or cylinders to force the rail ends together, and a frame to support the upsetting forces may be used.

In some embodiments, a means of applying heat to achieve the first heating step may be also applied during and/or shortly after the upsetting step. In other words, the first heating step and upsetting step may overlap. For example, if flash butt welding is used as the heating means in the first heating step, electric current may be flowed through the rail ends during and/or shortly after the upset process to minimize oxide formation on the surface and promote weld bond integrity. The length of overlap between the first heating step and the upsetting step may be up to 10 seconds, for example. In some embodiments, longer such overlaps may lead to increased softening in the softened regions, and may be detrimental.

It is contemplated that the upsetting step may be beneficial because a weld bond is formed between the rail ends and because weld material that may not be similar to or homogeneous with the parent rails can be expelled from the weld joint during this step.

Third step:

3. A first cooling step wherein a temperature range that may be below an A1 temperature is achieved in at least one austenitic region.

In a first embodiment, the first cooling step is further described:

During the first cooling step, a temperature range that may be below an A1 temperature but above a Bs temperature is achieved within at least one austenitic region.

In a second embodiment, the first cooling step is further described:

During the first cooling step, a temperature range that may be below a Bs temperature but above an Ms temperature is achieved within at least one austenitic region.

In a third embodiment, the first cooling step differs somewhat from what is described above, and is instead described as follows:

A first cooling step wherein a temperature range that may be below an Ms temperature is achieved within at least one austenitic region, such that at least some martensite may be formed from austenite in said austenitic region(s).

In such an embodiment, the total amount of martensite formed in the first cooling step is not specifically limited, although the martensite content may be considered to be at least 1% in one embodiment, at least 2% in another embodiment, or at least 5% in another embodiment.

The A1 temperature refers to the temperature at which pearlite forms from austenite on cooling, or austenite forms on heating. The Bs temperature refers to the bainite start temperature, or the temperature at which appreciable levels of bainite form. The Ms temperature refers to the martensite start temperature.

The means of cooling is not limited, but may include natural cooling, which includes radiation, natural convection, and heat conduction away from the heated ends of the rails. Additionally, forced cooling, such as flowing a gas, liquid, or a mixture of gas and liquid, may be used in this step. In an embodiment where forced cooling is used, the cooling may be applied to the head, web, and/or base of the rail, and may be applied to the weld bond, one or both austenitic regions, one or both softened regions, and/or one or both unaffected regions.

In some embodiments, during the first cooling step, heat is applied to the weld bond and one or both austenitic regions, but a rate of heat input may be lower than a rate of cooling, such that a temperature of at least one austenitic region may be decreasing with time. Such embodiments may be beneficial to gradually approach a desired transformation temperature range in the austenitic region(s), such as a temperature range where a desirable phase transformation occurs. In such embodiments, since the temperature of at least one austenitic region is decreasing with time, this may still constitute a cooling step, even though heat may be applied.

It is contemplated that the first cooling step may be beneficial to the method because softening within softened regions of the HAZ occurs due to subcritical and/or intercritical annealing, and the cooling may limit the extent of additional softening by lowering the temperature of the softened regions. The first cooling step may also result in some transformation of austenite within an austenitic region to another microstructure.

Fourth step in one embodiment:

4. A second heating step wherein
   a. Heat may be applied to at least one austenitic region to maintain the temperature of at least said austenitic region in a transformation temperature range below said A1 temperature for a length of time denoted as the transformation hold time, and b. At least some austenite in at least said austenitic region transforms to another microstructure during the second heating step In a first embodiment, the second heating step is further described:

During the second heating step, the transformation temperature range may be higher than said Bs temperature but lower than said A1 temperature, and the transformation hold time may be sufficiently long such that at least one austenitic region achieves a substantially pearlitic microstructure.

In such an embodiment, a substantially pearlitic microstructure indicates that the microstructure has a pearlite content of at least 80% and a (pearlite+ferrite) content of at least 95%. In a eutectoid steel, the pearlite content may be very near 100%. However, in hypoeutectoid steels, up to 20% ferrite may be acceptable in the microstructure for certain applications. In a hypereutectoid steel, the microstructure may still be very nearly 100% pearlitic if the cementite content in the pearlite is higher than the equilibrium value. In the case of a hypoeutectoid steel, a eutectoid steel, or a hypereutectoid steel, not more than 5% of the microstructure should be other than (pearlite+ferrite), and not more than 20% of the microstructure should be other than pearlite. The transformation hold time required to form a substantially pearlitic structure may be influenced by the steel composition and the prior thermal history, and thus the transformation hold time is not specifically limited. However, the transformation hold time may range between 5 to 600 seconds, 10 to 450 seconds, or 30 to 300 seconds.

In a second embodiment, the second heating step is further described:

During the second heating step, the transformation temperature range may be higher than said Ms temperature but lower than said A1 temperature, and the transformation hold time may be sufficiently long such that at least said austenitic region achieves a microstructure containing a (bainite+pearlite+ferrite) content of at least 95%, and During the first cooling step and/or the second heating step, at least some austenite in at least said austenitic region transforms to bainite.

The transformation hold time required to achieve a microstructure containing a (bainite+pearlite+ferrite) content of at least 95% may be influenced by the steel composition and the prior thermal history, and thus the transformation hold time is not specifically limited. However, the transformation hold time may range between 5 to 600 seconds, 10 to 450 seconds, or 30 to 300 seconds. In such an embodiment, some amount of bainite may be formed in the first cooling step and/or the second heating step, although at least some austenite in at least one austenitic region may transform to another microstructure during the second heating step. The total amount of bainite formed in the first cooling step and the second heating step is not specifically limited, although the bainite content may be considered to be at least 1% in one embodiment, at least 2% in another embodiment, or at least 5% in another embodiment.

In a third embodiment, the second heating step differs somewhat from the above descriptions and is described instead as follows:

Fourth step in another embodiment:

4. A second heating step wherein a. Heat may be applied to at least one austenitic region to raise and maintain the temperature of at least said austenitic region above the Ms temperature but below the A1 temperature for sufficient time, such that at least said austenitic region achieves a microstructure containing at least some tempered martensite and a (tempered martensite+bainite+pearlite+ferrite) content of at least 95%, wherein b. Tempered martensite may be defined as martensite with a hardness less than or equal to 600 Hv.

This third embodiment corresponds to the third embodiment described above for the first cooling step. In such an embodiment, the martensite formed during the first cooling step may be subsequently substantially tempered in the second heating step. In such an embodiment, the total amount of martensite tempered during the second heating step is not specifically limited, although the tempered martensite content may be considered to be at least 1% in one embodiment, at least 2% in another embodiment, or at least 5% in another embodiment.

In the third embodiment, appreciable amounts austenite remaining in the austenitic region(s) (if austenite still remains in the austenitic regions after the first cooling step) are substantially transformed to pearlite, bainite, ferrite, and/or cementite during the second heating step. The time required to achieve a microstructure containing a (tempered martensite+bainite+pearlite+ferrite) content of at least 95% may be influenced by the steel composition and the prior thermal history, and thus the time required is not specifically limited. However, the time required may range between 5 to 600 seconds, 10 to 450 seconds, or 30 to 300 seconds.

The means of heating during the second heating step are not limited, as long as the means of heating can achieve the temperature, time, and microstructural conditions described above. Nonetheless, the means of heating during the second heating step may include electric resistance, induction, convection, and/or radiation used individually, sequentially, or simultaneously. For example, if the means of heating during the first heating step is an electric flash butt welder, then the welder itself may be used in the second heating step by passing current through the flash butt welder electrodes into the rails, thus heating the material between the welder electrodes, which includes the weld bond, both austenitic regions, both softened regions, and portions of both unaffected regions. Additionally, an induction coil(s) may be used as the heating means during the second heating step. For example, an induction coil(s) may be fabricated into a shape that approximately conforms to the rail profile, allowing for a gap between the inductor and the rail profile. If such an inductor coil(s) is disposed to the weld, it may heat at least one austenitic region as described above.

During the second heating step, the A1 temperature may be the maximum temperature that can be used to transform austenite to another microstructure, since at temperatures above the A1 temperature austenite may be stable and additional austenite may form at the expense of other microstructures that may be present. However, in some embodiments, it may be beneficial to specify a maximum temperature that is lower than the A1 temperature. For example, utilizing a lower maximum temperature during the second heating step may result in smaller softened regions adjacent to the austenitic regions by reducing the total heat input and reducing the amount of pearlite spheroidization that occurs. Thus in some embodiments, the maximum temperature during the second heating step may be restricted to 700° C. In other embodiments, the maximum temperature during the second heating step may be restricted to 650° C. In other embodiments, the maximum temperature during the second heating step may be restricted to 600° C. In other embodiments, the maximum temperature during the second heating step may be restricted to 550° C. In other embodiments, the maximum temperature during the second heating step may be restricted to 500° C.

In some embodiments, the second heating step may be used to slow a rate of cooling through a temperature range of interest for the second heating step, arrest cooling in a temperature range of interest for the second heating step, maintain a temperature range of interest for the second heating step, and/or increase the temperature to and/or within a temperature range of interest for the second heating step. The temperature range of interest for the second heating step may be a transformation temperature range, a tempering temperature range, an annealing temperature range, and/or another temperature range below the A1 temperature.

In some embodiments, during the second heating step, heat may be applied substantially to the entire profile of at least one austenitic region, including the rail base, web, and head. Applying heat in this manner may be beneficial because it may promote the most uniform microstructural and mechanical properties in the austenitic region(s) once the welded joint has cooled to ambient temperature. For some heating means, it may be helpful to have small gaps between heating elements, such that most of the rail profile is heated, except for the small gaps. For example, if two induction coils are each fabricated to heat half of the rail profile and are disposed to the welded joint, they may heat the majority of the weld profile, but the two inductor coils may need to maintain a small gap from one another to prevent mechanical and/or electrical interference. Additionally, if a burner assembly is fabricated into a shape that approximately conforms the rail profile, the individual burners may not cover the entire profile, and small gaps may exist between burners. However, in either case the gaps between heating elements (induction coils or burners) are relatively small and heat can be easily conducted to the gaps by the adjacent heating elements.

In some embodiments, non-uniform application of the second heating step may be utilized. For example, the second heating step may be applied to a rail web of an austenitic region to influence the microstructure and/or hardness formed in the web of the austenitic region. The web may contain enriched (higher) levels of alloying elements due to chemical segregation from the rail manufacturing process. Higher levels of alloying may result in a greater tendency to form harder and more brittle microstructures, and thus the web of an austenitic region may benefit from a second heating step that differs from the second heating step of a head and/or a base of an austenitic region. Additionally, areas of the web, head, and/or base of an austenitic region may have locally enriched (higher) levels of alloying elements compared to other areas due to chemical segregation from the rail manufacturing process, and these locally enriched areas may benefit from a second heating step that differs from the second heating step in areas that are not locally enriched. Non-uniform application of the second heating step may include excluding portions of the rail profile or section from the second heating step. For example, the second heating step may exclude the rail base, the rail web, or the rail head in various combinations, so long as some material within the austenitic region of one of the two steel rails is heated during the second heating step.

In some embodiments, the second heating step produces hardness values in at least one austenitic region that are less than or equal to the hardness achieved in said austenitic region in a reference condition that may be achieved by a reference method that does not implement a second heating step, but may be otherwise substantially identical to the claimed method. Such embodiments represent a condition where the second heating step may be used to control the formation of microstructures that are harder/more brittle than the unaffected pearlitic microstructure. Controlling the formation of harder/more brittle microstructures can mean promoting pearlite formation over bainite and/or martensite formation, promoting bainite formation over martensite formation, promoting tempering of martensite, promoting annealing of bainite, and/or promoting pearlite with an interlamellar spacing that may be more similar to the unaffected pearlite interlamellar spacing over one that is finer than the unaffected pearlite interlamellar spacing.

In some embodiments, during the second heating step, heat may be also applied to the softened region and/or the unaffected region of one or both sides of the weld bond. Such embodiments represent scenarios in which the heat may not be precisely directed at one or both austenitic regions, including or excluding the weld bond, and some heating of the adjacent regions, such as the softened regions and/or unaffected regions, may be difficult to avoid due to the nature of the heating means. For example, if electric flash butt welder electrodes are used to heat the welded joint, the softened regions and unaffected regions may be heated in addition to an austenitic region. Additionally, if induction heating and/or burners are used, some heat may be directed outside of an austenitic region. In any of these scenarios, the heating may be targeted at one or both austenitic regions, including or excluding the weld bond, and heating outside of these regions is incidental. In such cases, the heating may be applied substantially to the entire profile of the softened region and/or the unaffected region of one or both sides of the weld bond, including the rail base, web, and head. Similarly to the description above, there may be small gaps around the rail profile where the heating may be not applied.

It is contemplated that the second heating step may be beneficial to the method because it may be used to maintain an austenitic region(s) within temperature range(s), influence the microstructure that forms in the austenitic region(s), and/or influence the hardness of the austenitic region(s) in a manner that is substantially separate from the first heating step. Without a second heating step, the thermal history of, and resulting microstructure and hardness of, the austenitic region(s) of the HAZ may only be influenced by the extent of heat input during the first heating step. For example, without a second heating step, the post-weld cooling rate of the austenitic region(s) may only be decreased (for the purpose of avoiding undesirable brittle microstructures) by increasing the heat input in the first heating step. Increasing the heat input in the first heating step may have other consequences, such as wider and softer softened regions of the HAZ. Furthermore, a second heating step that is performed in a temperature range above the A1 temperature may result in the formation of not only additional austenite, but also additional softening. Therefore, the present method allows (1) limited heat input in the first heating step such that the size and extent of softening in the softened region(s) of the HAZ are reduced, and (2) controlled heat input in a second heating step that can influence the microstructure and hardness of the austenitic region(s) by controlling the thermal history of the austenitic region(s). The ability to influence the post-weld thermal history of the weld, including the austenitic region(s) of the HAZ, separately from the heat input of the first heating step is also useful because in some cases it may be undesirable or impractical to alter the heat input of the first heating step.

The following optional additional steps are also contemplated:

First Optional Additional Step:

1. Excess upset material that protrudes beyond the original profile of the rails may be removed either partially or fully:
   a. After the upsetting step but before the second heating step. In this embodiment, a shear may be used to remove a large portion of the excess material while it may be in a high temperature soft condition.
   b. After the second heating step. In this embodiment, a grinder or other similar metal removal device may be used, particularly when the weld joint has cooled to some degree. This embodiment may be useful to blend the welded area and achieve a substantially smooth transition between the weld joint and the parent rails, such that a passing wheel experiences minimal perturbation due to the weld geometry.

Second Optional Additional Step:

2. A second cooling step may be applied after the second heating step, wherein the weld bond and the austenitic regions, softened regions, and unaffected regions on both sides of the weld bond are cooled to ambient temperature.
   a. The welded joint may ultimately be subjected to use in ambient conditions. However, the weld can be subject to additional processing steps, such as removing excess material, adjusting the alignment of the weld joint, loading the weld joint onto a weld train, etc. before this step may be complete. Thus it may be treated separately from the four steps that are required to achieve the novel aspects of the present invention.
   b. The possible means of achieving the first cooling step are also suitable for the second cooling step.

Third Optional Additional Step:

3. The alignment of the steel rails and/or the welded joint are altered after the upsetting step.
   a. In addition removing excess material to improve weld geometry, it may be beneficial to alter the alignment of the steel rails relative to one another and/or the welded joint after the weld bond has been established during the upsetting step. For example, a hydraulic press may be used to alter the alignment, particularly after the welded joint has cooled off to some degree and its geometry at ambient temperature may be either known or can be inferred. The alignment may be altered in a vertical and/or horizontal direction.

It is contemplated that a benefit of the present invention may be that it provides a means of forming a weld joint between two rails wherein the microstructure and mechanical properties of the austenitic regions of the heat affected zones (HAZs), which are created within the rails as a result of the heat input from welding, can be modified after the weld bond has been formed. In a conventional flash butt weld, for example, a large amount of heat may be input into the rail ends to, in part, control the phase transformation in the austenitic regions of the HAZs. However, the use of a large heat input may not be desirable in some circumstances because a large heat input during welding also results in large softened regions in the HAZs adjacent to the austenitic regions in the HAZs. Large softened regions are more likely to sustain plastic deformation and damage during repeated contact with railroad wheels because (i) less of the contact stress from the wheel can be supported by adjacent harder material and (ii) larger soft regions tend to have a lower minimum hardness, which results in greater plastic deformation for a given contact stress.

Another contemplated benefit of the present invention may be that the microstructure and mechanical properties of the austenitic regions of the HAZ can be modified after the weld bond has been formed and in a temperature range wherein the austenite in the austenitic regions can transform to desirable microstructures. Depending on the application and the desired mechanical properties, the austenitic regions may form pearlite, bainite, and/or tempered martensite. The properties of the pearlite can be adjusted by adjusting the interlamellar spacing of the pearlite, which in turn may be dictated in part by the time and temperature ranges in which the austenite to pearlite transformation takes place. The properties of bainite can be adjusted by adjusting the time and temperature ranges in which the austenite to bainite transformation takes place, and also by annealing of the bainite, which may be influenced by the time and temperature ranges used. The properties of martensite can be adjusted by adjusting the tempering time and temperature ranges. For example, longer tempering times and higher tempering temperatures may result in reduced martensite hardness. Since bainite and martensite may have reduced wear performance relative to pearlite at a given hardness level, it may be desirable to modify the hardness of bainite and/or martensitic microstructures relative to the pearlite hardness in the unaffected regions of the parent rails, which are substantially pearlitic.

Yet another contemplated benefit of the present invention may be that the microstructure and mechanical properties of the austenitic regions of the HAZ can be modified after the weld bond has been formed and in a temperature range wherein there may be minimal additional softening of the softened regions that are adjacent to the austenitic regions of the HAZs. The softened regions contain a spheroidized microstructure in which the lamellar cementite plates in the original pearlitic structure are at least partially spheroidized by the heat input from welding (i.e. the first heating step). The driving force for spheroidization may be a reduction in the overall surface area (energy) between ferrite and cementite. A spherical arrangement of cementite provides reduced surface area (energy) compared to a lamellar arrangement of cementite. The spheroidization process can occur in an intercritical temperature range (between the A1 and Acm temperatures) or in a subcritical temperature range (below the A1 temperature). The degree of spheroidization decreases as the temperature and duration of exposure to temperature decrease. Thus to reduce softening due to spheroidization in a welded joint between two rails, which includes the width of spheroidized material and the extent of spheroidization within said material, the exposure time in a temperature regime wherein spheroidization occurs may be reduced. In the present invention, a reduced heat input can be utilized in the first heating step, and the microstructure and mechanical properties formed in the austenitic regions can be managed by the first cooling step and the second heating step. The second heating step may be beneficial, because this heating step, by definition, is carried out below the A1 temperature. Thus, the second heating step may not promote intercritical spheroidization. Furthermore, the second heating step can be carried out using time and temperature combinations that minimize additional subcritical spheroidization. For example, a second heating step carried out at approximately 600° C. for 300 seconds may cause minimal additional spheroidization, but may be sufficient to promote austenite to pearlite transformation, austenite to bainite transformation, bainite annealing, and/or martensite tempering. The temperature range and exposure time required to achieve desirable microstructures in the austenitic regions may be lower than the temperature range and exposure time in which pearlitic cementite spheroidizes in the adjacent softened regions.

The above contemplated benefits of the present invention demonstrate a means for controlling the thermal history in the austenitic regions (a second heating step) that may be independent from the weld heat input (first heating step). Thus reduced weld heat input can be used (during the first heating step) to reduce the extent of softening in softened regions, while the second heating step can be implemented to achieve desirable microstructures and properties in the austenitic regions. The present invention may make novel use of the fact that austenite decomposition to pearlite, bainite, and/or martensite, and (if applicable) any subsequent bainite annealing or martensite tempering, can be carried out in a temperature range that may be below a temperature range in which appreciable pearlite spheroidization occurs. For example, if the second heating step is applied while the temperature of the weld joint is too hot (i.e. too soon after the upsetting step), the contemplated benefit of reducing the extent of softening in the softened regions may not be fully realized. Similarly, if the second heating step is eliminated and the heat input in the first heating step is correspondingly increased to reduce the cooling rate of the austenitic regions, the contemplated benefit of reducing the extent of softening in the softened regions may not be fully realized.

In addition to the contemplated benefits described above, the following additional contemplated benefits may also be realized by the present invention.

First additional contemplated benefit:

1. A reduced heat input may be used during the first heating step.
   a. For example, if the first heating step is accomplished using electric flash butt welding, the welding cycle may be reduced and welder component life may be increased.
   b. For example, if the first heating step is accomplished using electric flash butt welding, the tendency for localized melting of carbon-enriched material (liquation) that can penetrate into the austenitic regions may be decreased by decreasing the weld heat input; the liquation process requires the presence of locally melted material, and thus happens at temperatures in excess of at least approximately 1250° C. These elevated temperatures are commonly achieved in a flash butt weld. However, by using a second heating step at a temperature below the A1 temperature, which may be below the temperature range where liquation can occur, the heat input during the first heating step (flash butt welding) can be reduced. The liquated material, although not commonly observed, may be undesirable because it has a high carbon content and results in a coarse cementite network.
   c. For example, if the first heating step is accomplished using electric flash butt welding, the molten ends of the rails may be exposed to the welding atmosphere for a shorter period of time, which reduces the opportunity for the molten rail ends to become oxidized and accumulate oxide inclusions, which may subsequently become entrapped at the weld bond. Such oxide inclusions may not be desirable at the weld bond, since they are nonmetallic flaws that may initiate cracks.

Second additional contemplated benefit:

2. The second heating step, although designed to control the microstructure and properties in the austenitic regions of the HAZ while minimizing softening in the softened regions, may also provide some benefit in residual stress; residual stress can arise due to non-uniform cooling (thermal contraction) and/or non-uniform austenite decomposition (volume change due to phase transformation).
   a. During the second heating step, the temperature (thermal contraction), the austenite decomposition, and, if applicable, any subsequent tempering or annealing of the microstructure can be controlled in a manner that may be relatively homogeneous across the rail profile or section in some embodiments, and the residual stresses may also be influenced in a beneficial manner.
   b. In some embodiments, it may be beneficial to apply the second heating step in a non-uniform manner over the rail profile or section. For example, the rail head, web, and/or base of the rail may not all cool at the same rate due to differences in welding heat input, differences in surface area-to-volume ratio, and/or differences in cooling conditions during the first cooling step. For example, the web may cool more quickly during the first cooling step than the head and/or the base in the absence of a second heating step. A non-uniform second heating step provides one means to increase or decrease the differences in cooling rate that would otherwise occur over the rail profile or section. Non-uniform application of the second heating step may include excluding portions of the rail profile or section from the second heating step. For example, the second heating step may exclude the rail base, the rail web, or the rail head in various combinations, so long as some material within the austenitic region of one of the two steel rails is heated during the second heating step.
   c. In some embodiments it may be beneficial to apply the second heating step in a non-uniform manner as a means to influence the timing in which various portions of the weld experience thermal contraction and/or austenite decomposition, bainite annealing, and/or martensite tempering. The timing in which portions of the weld experience these processes may influence residual stress. For example, it may be beneficial for the rail web of the weld to undergo thermal contraction and/or austenite decomposition at a different time than the rail head and/or rail base of the weld. For example, it may be beneficial for the rail base of the weld to undergo thermal contraction and/or austenite decomposition at a different time than the rail head and/or rail web of the weld. It may also be beneficial for the rail head of the weld to undergo thermal contraction and/or austenite decomposition at a different time than the rail web and/or rail web of the weld.

Third additional contemplated benefit:

3. Bainite and/or tempered martensite may provide beneficial toughness characteristics relative to the substantially pearlitic rail material.

The present invention described in detail above allows for the use of a reduced welding heat input, which allows for reduced annealing in the softened HAZs, by use of a post-weld heat treatment step that influences the austenite phase transformation behavior in the austenitic region(s) of the HAZ. The post-weld heat treatment may also influence the residual stress development. The post-weld heat treatment step disclosed in this invention can be implemented in a manner that minimizes additional annealing in the softened HAZs, thus allowing for an improved combination of smaller and harder softened HAZs along with desirable austenite phase transformation behavior in the reaustenitized HAZs and desirable residual stress in the weld.

The use of the present invention is not limited by specific rail sections, grades, chemistries, or hardness levels. For example, for high strength (hardness) rail grades, including those that have undergone a head hardening process during manufacturing, the present invention may provide a means for the softened HAZs to be reduced in size and/or severity and the reaustenitized HAZs to achieve a microstructure and hardness that is comparable to the parent rail. The ability to reduce the size and/or severity of the softened HAZs in high hardness rails is beneficial because the relative softening between the softened HAZ and the parent rail may be more pronounced for high hardness rails compared to low hardness rails. Thus, the softened HAZs of high hardness rails may experience more localized plastic flow and/or wear as compared to the adjacent austenitic region(s) of the HAZ and unaffected region(s).

In the case of standard strength rails with lower hardness, including those that have not been head hardened, the present invention may provide a means of achieving a microstructure and hardness in the austenitic regions of the HAZ that is more comparable to the parent rail while limiting the size and/or severity of the softened regions of the HAZ. The ability to influence microstructure and hardness in the austenitic regions of the HAZ of standard strength rails is beneficial because the reaustenitized HAZs may form higher hardness microstructures compared to the unaffected region(s) if the post-weld cooling rate is sufficiently high. The higher hardness may be the result of a finer interlamellar spacing in the pearlite that transforms from austenite in the austenitic region(s) of the HAZ.

In the case of intermediate strength (hardness) rails, including those that have been head hardened and those that have not been head hardened, the present invention provides a means for the softened regions of the HAZ to be reduced in size and/or severity and the austenitic regions of the HAZ to achieve a microstructure and hardness that is comparable to the parent rail.

As a non-limiting description, standard strength rails may have a hardness exceeding 320 Brinell (BHN), intermediate strength rails may have a hardness exceeding 350 BHN, and high strength rails may have a hardness exceeding 370 BHN.

As a non-limiting description, it is beneficial for the reaustenitized HAZ to achieve a microstructure and hardness similar to that of the parent rail. As an example only, it may be beneficial for the reaustenitized HAZ to have a hardness within +/−5 Rockwell C (HRc) of the parent rail.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims and their equivalents.

What is claimed is:

1. A method for creating a welded joint between ends of two steel rails, wherein the two steel rails have a substantially pearlitic microstructure, the method comprising:

a first heating step wherein the ends of the two steel rails are heated to obtain within the two steel rails:

an austenitic region comprising a microstructure substantially of austenite, the austenitic region being within and/or adjacent to the ends of the two steel rails, a softened region adjacent to the austenitic region, the softened region comprising a microstructure substantially of softened, annealed, spheroidized, and/or degenerate pearlite, and an unaffected region adjacent to the softened region, the unaffected region comprising a microstructure that has not been substantially altered as compared to a starting microstructure of the two rails;

an upsetting or forging step wherein the ends of the two steel rails are forced together to obtain:

a weld bond between the ends of the two steel rails, a remaining austenitic region on both sides of the weld bond, a remaining softened region on both sides of the weld bond, and a remaining unaffected region on both sides of the weld bond;

a cooling step wherein a temperature of the austenitic region on at least one side of the weld bond is below an A1 temperature; and a second heating step wherein heat is applied directly to the weld bond and to the austenitic region on at least one side of the weld bond via an external source to maintain the temperature of the weld bond and the at least said austenitic region on at least one side of the weld bond in a temperature range below said A1 temperature, no additional austenite is formed, and a hardness of the austenitic region on at least one side of the weld bond after the second heating step is less than or equal to a hardness in the austenitic region on at least one side of the weld bond without the second heating step.

2. The method of claim 1, wherein during the second heating step:

the temperature range below said A1 temperature is a transformation temperature range that is maintained for a transformation hold time, and at least some of the austenite in at least said austenitic region transforms to another microstructure.

3. The method of claim 2, wherein during the first cooling step, the temperature in the austenitic region of at least one of the two steel rails is reduced to below the A1 temperature and above a Bs temperature, and during the second heating step, the transformation temperature range is higher than said Bs temperature but lower than said A1 temperature, and the transformation hold time is sufficiently long such that at least said austenitic region achieves a microstructure containing a pearlite content of at least 80% and a (pearlite+ferrite) content of at least 95%.

4. The method of claim 2, wherein during the first cooling step, the temperature in the austenitic region of at least one of the two steel rails is below a Bs temperature and above an Ms temperature, during the second heating step, the transformation temperature range is higher than said Ms temperature and lower than said A1 temperature, and the transformation hold time is sufficiently long such that at least said austenitic region achieves a microstructure containing a (bainite+pearlite+ferrite) content of at least 95%, and during the first cooling step and/or the second heating step, at least some austenite in at least said austenitic region transforms to bainite.

5. The method of claim 2, wherein the austenitic region of at least one of the two steel rails contains a microstructure with an austenite content of at least 5% at a time when the second heating step is initiated.

6. The method of claim 2, wherein during the second heating step, heat is applied to at least a web of the austenitic region of at least one of the two steel rails.

7. The method of claim 2, wherein hardness in the austenitic region of at least one of the two steel rails resulting from the second heating step is less than or equal to a hardness in the austenitic region without the second heating step.

8. The method of claim 2, wherein a longitudinal distance (Lh) is a distance between an outer extent of an austenitic region in one of the two steel rails to an outer extent of the austenitic region in the other of the two steel rails, a weld joint centerline is halfway between outer extents of the austenitic regions of the two steel rails, and during the second heating step, heat is applied to the austenitic region of at least one of the two steel rails within a distance of 0.2Lh from the weld joint centerline.

9. The method of claim 2, wherein during the second heating step, heat is also applied to the weld bond, the softened region and/or the unaffected region on one or both sides of the weld bond.

10. The method of claim 9, wherein during the second heating step, the heat is also applied to at least a web of the weld bond, softened region and/or the unaffected region of one or both sides of the weld bond.

11. The method of claim 2, wherein a means of applying heat to achieve the first heating step is also applied during and/or for up to 10 seconds after the upsetting step.

12. The method of claim 2, wherein during the first cooling step, heat is applied to the weld bond, one austenitic region, and/or both austenitic regions, and a rate of heat input is lower than a rate of cooling, such that a temperature of at least one austenitic region decreases with time.

13. The method of claim 2, wherein during the first heating step, the heat is applied using electric flashing, electric resistance, induction, friction, laser beam, convection, radiation, and/or exothermic reaction, applied individually, sequentially, or simultaneously.

14. The method of claim 2, wherein natural cooling is used during the first cooling step.

15. The method of claim 2, wherein during the first cooling step, the cooling is achieved at least in part by flowing a cooling media over the weld bond and/or the austenitic region, softened region, and/or unaffected region on one or both sides of the weld bond.

16. The method of claim 2, wherein during the second heating step, the heat is applied using electric resistance, induction, convection, and/or radiation, applied individually, sequentially, or simultaneously.

17. The method of claim 2, further comprising a step of partially or fully removing an upset material that protrudes beyond an original profile of the two rails after the upsetting step and before the second heating step.

18. The method of claim 2, further comprising a step of partially or fully removing an upset material that protrudes beyond an original profile of the two rails after the second heating step.

19. The method of claim 2, further comprising a second cooling step after the second heating step, wherein the weld bond and the austenitic regions, softened regions, and unaffected regions on both sides of the weld bond are cooled to ambient temperature.

20. The method of claim 19, wherein natural cooling is used during the second cooling step.

21. The method of claim 19, wherein during the second cooling step, the cooling is achieved at least in part by flowing a cooling media over the weld bond and/or the austenitic region, softened region, and/or unaffected region on one or both sides of the weld bond.

22. The method of claim 2, wherein an alignment of the two rails and/or the welded joint are altered after the upsetting step.

23. The method of claim 1, wherein during the first cooling step wherein said temperature below an A1 temperature is below an Ms temperature, such that at least some martensite is formed from austenite in at least said austenitic region; and during the second heating step:

the temperature range below said A1 temperature is also above the Ms temperature, and the temperature range is maintained between the A1 temperature and the Ms temperature for a predetermined time such that at least said austenitic region achieves a microstructure containing at least some tempered martensite and a (tempered martensite+bainite+pearlite+ferrite) content of at least 95%, and wherein tempered martensite is martensite with a hardness less than or equal to 600 Hv.

24. The method of claim 23, wherein the austenitic region of at least one of the two steel rails contains a microstructure with an austenite content of at least 5% at a time when the second heating step is initiated.

25. The method of claim 23, wherein during the second heating step, heat is applied to at least a web of the austenitic region of at least one of the two rails.

26. The method of claim 23, wherein hardness in the austenitic region of at least one of the two steel rails resulting from the second heating step is less than or equal to a hardness in the austenitic region without the second heating step.

27. The method of claim 23, wherein a longitudinal distance (Lh) is a distance between an outer extent of an austenitic region in one of the two steel rails to an outer extent of the austenitic region in the other of the two steel rails, a weld joint centerline is halfway between outer extents of the austenitic regions of the two steel rails, and during the second heating step, heat is applied to the austenitic region of at least one of the two steel rails within a distance of 0.2Lh from the weld joint centerline.

28. The method of claim 23, wherein during the second heating step, heat is also applied to the weld bond, the softened region and/or the unaffected region on one or both sides of the weld bond.

29. The method of claim 28, wherein during the second heating step, the heat is also applied to at least a web of the weld bond, softened region and/or the unaffected region of one or both sides of the weld bond.

30. The method of claim 23, wherein a means of applying heat to achieve the first heating step is also applied during and/or for up to 10 seconds after the upsetting step.

31. The method of claim 23, wherein during the first cooling step, heat is applied to the weld bond, one austenitic region, and/or both austenitic regions, and a rate of heat input is lower than a rate of cooling, such that a temperature of at least one of the austenitic regions decreases with time.

32. The method of claim 23, wherein during the first heating step, the heat is applied using electric flashing, electric resistance, induction, friction, laser beam, convection, radiation, and/or exothermic reaction, applied individually, sequentially, or simultaneously.

33. The method of claim 23, wherein natural cooling is used during the first cooling step.

34. The method of claim 23, wherein during the first cooling step, the cooling is achieved at least in part by flowing a cooling media over the weld bond and/or the austenitic region, softened region, and/or unaffected region on one or both sides of the weld bond.

35. The method of claim 23, wherein during the second heating step, the heat is applied using electric resistance, induction, convection, and/or radiation, applied individually, sequentially, or simultaneously.

36. The method of claim 23, further comprising a step of partially or fully removing an upset material that protrudes beyond an original profile of the two steel rails after the upsetting step and before the second heating step.

37. The method of claim 23, further comprising a step of partially or fully removing an upset material that protrudes beyond an original profile of the two steel rails after the second heating step.

38. The method of claim 23, further comprising a second cooling step after the second heating step, wherein the weld bond and the austenitic regions, softened regions, and unaffected regions on both sides of the weld bond are cooled to ambient temperature.

39. The method of claim 38, wherein natural cooling is used during the second cooling step.

40. The method of claim 38, wherein the during the second cooling step, the cooling is achieved at least in part by flowing a cooling media over weld bond and/or the austenitic region, softened region, and/or unaffected region on one or both sides of the weld bond.

41. The method of claim 23, wherein an alignment of the two steel rails and/or the welded joint are altered after the upsetting step.

* * * * *